US007536298B2

(12) United States Patent
Ramkumar et al.

(10) Patent No.: US 7,536,298 B2
(45) Date of Patent: May 19, 2009

(54) METHOD OF COMFORT NOISE GENERATION FOR SPEECH COMMUNICATION

(75) Inventors: Permachanahalli S Ramkumar, Kamataka (IN); Shashi Shankar Hosur, Kamataka (IN)

(73) Assignee: Intel Corporation, Santa Clara, CA (US)

( * ) Notice: Subject to any disclaimer, the term of this patent is extended or adjusted under 35 U.S.C. 154(b) by 803 days.

(21) Appl. No.: 10/802,135

(22) Filed: Mar. 15, 2004

(65) Prior Publication Data

US 2005/0203733 A1 Sep. 15, 2005

(51) Int. Cl.
*G10L 19/00* (2006.01)

(52) U.S. Cl. ..... 704/201; 704/206; 704/208; 704/223

(58) Field of Classification Search ..... 704/201, 704/223, 208, 206
See application file for complete search history.

(56) References Cited

U.S. PATENT DOCUMENTS

| | | | | |
|---|---|---|---|---|
| 6,226,607 | B1 * | 5/2001 | Chang et al. | 704/221 |
| 6,813,602 | B2 * | 11/2004 | Thyssen | 704/222 |
| 2001/0007974 | A1 * | 7/2001 | Chang et al. | 704/230 |
| 2003/0200092 | A1 * | 10/2003 | Gao et al. | 704/258 |
| 2004/0088742 | A1 * | 5/2004 | LeBlanc et al. | 725/149 |

OTHER PUBLICATIONS

Khaled El-Maleh, et al., "Natural-Quality Background Noise Coding Using Residual Substitution", Eurospeech 1999, vol. 5, Sep. 5, 1999, McGill University, Montreal, Qubec, Canada.

Benyassine A., et al., "ITU-T Recommendation G. 729 Annex B: A Silence Compression Scheme For Use WIth G. 729 Optimized For V.70 Digital Simultaneous Voice And Data Applications", IEEE Comunications Magazine, IEEE Service Center, vol. 35, No. 9, Sep. 1997, pp. 64-73, Piscataway, NJ, USA.

"Coding of Speech at 8 KBIT/S Using Conjugate Structure Algebraic-Code-Excited Linear-Prediction (CS-ACELP). Annex B: A Silence Compression Scheme For G.729 Optimized Terminals Comforming To Recommendation V.70", ITU-T Recommendation G.729, Nov. 1996.

International Telecommunication Union, ITU-T Recommendation G.729, Annex B, A Silence Compression Scheme for G.729 Optimized for Termianls Conforming Recommendation V.70, Nov. 1996, pp. 1-23.

International Telecommunication Union, ITU-T Recommendation G.729, Coding of Speech at 8 kbits/s Using Conjugates-Structure Algebraic-Coda-Excited Linear-Prediction (CS-ACELP) Mar. 1996, pp. 1-39.

EPO, "42P17109EP OA Mailed Jul. 6, 2007 for EP Patent Application 05725644,8". (Jul. 6, 2007), Whole Document.

* cited by examiner

*Primary Examiner*—Qi Han
(74) *Attorney, Agent, or Firm*—Blakely, Sokoloff, Taylor & Zafman LLP

(57) ABSTRACT

An embodiment of the invention improves upon the International Telecommunication Union's ITU-T G.729 Annex B comfort noise generation algorithm by reducing the computational complexity of the comfort noise generation algorithm. The computational complexity is reduced by reusing pre-computed random Gaussian noise samples for each non active voice frame versus calculating new random Gaussian noise samples for each non active voice frame as described by Annex B.

24 Claims, 3 Drawing Sheets

METHOD OF COMFORT NOISE GENERATION FOR SPEECH COMMUNICATION

FIELD

Embodiments of the invention relate to speech compression in telecommunication applications, and more specifically to generating comfort noise to replace silent intervals between spoken words during Internet or multimedia communications.

BACKGROUND

Despite the proliferation of alternative modes of communication, verbal communication is often the preferred method for exchanging information. In particular, telephonic communication has enabled speaking and listening between two parties to span the globe. The intersection of current digital and Internet technology and voice communication, however, is not without challenges.

One such challenge is efficiently utilizing available bandwidth. Digital communication systems necessarily require converting analog voice or audio signals to digital signals. The digital signals in turn occupy bandwidth as they navigate to their destination. Maximizing bandwidth, and the efficient utilization thereof, are omnipresent concerns for Internet and multimedia communications.

Another challenge is creating a communication environment with which the users are familiar and comfortable. The benchmark for voice and noise communication is the telephone. Telephonic communication is rich with sounds, inflections, nuances, and other characteristics of verbal communication. The extra features available to verbal communication add context to the communication and should be preserved in Internet or multimedia communication applications. Further, the connection is always open in the sense that during of the telephone call, each call participant can generally hear what is happening on the other end. Unfortunately, transmitting silence, or background noise without any accompanying voice, is an inefficient bandwidth use for most communication applications.

The International Telecommunication Union Recommendation G.729 ("G.729") describes fixed rate speech coders for Internet and multimedia communications. In particular, the coders compress speech and audio signals at a sample rate of 8 kHz to 8 kbps. The coding algorithm utilizes Conjugate-Structure Algebraic-Code-Excited-Linear-Prediction ("CS-ACELP") and is based on a Code-Exited Linear-Prediction ("CELP") coding model. The coder operates on 10 millisecond speech frames corresponding to 80 samples at 8000 samples per second. Each transmitted frame is first analyzed to extract CELP model parameters such as linear-prediction filter coefficients, adaptive and fixed-codebook indices and gains. The parameters are encoded and transmitted. At the decoder side, the speech is reconstructed by utilizing a short-term synthesis filter based on a 10th order linear prediction. The decoder further utilizes a long-term synthesis filter based on an adaptive codebook approach. The reconstructed speech is post-filtered to enhance speech quality.

G.729 Annex B ("Annex B") defines voice activity detection ("VAD"), discontinuous transmission ("DTX"), and comfort noise generation ("CNG") algorithms. In conjunction with the G.729, Annex B attempts to improve the listening environment and bandwidth utilization over that created by G.729 alone. In short, and with reference to FIG. 1, the algorithms and systems employed by Annex B detect the presence or absence of voice activity with a VAD 104. When the VAD 104 detects voice activity, it triggers an Active Voice Encoder 103, transmits the encoded voice communication over a Communication Channel 105, and utilizes an Active Voice Decoder 108 to recover Reconstructed Speech 109. When the VAD 104 does not detect voice activity, it triggers a Non Active Voice Encoder 102, that in conjunction with the Communication Channel 105 and a Non Active Voice Decoder 107, transmits and recovers Reconstructed Speech 109.

The nature of Reconstructed Speech 109 depends on whether or not the VAD 104 has detected voice activity. When VAD 104 detects voice activity, the Reconstructed Speech 109 is the encoded and decoded voice that has been transmitted over Communication Channel 105. When VAD 104 does not detect voice activity, Reconstructed Speech 109 is comfort noise per the Annex B CNG algorithm. Given that in general, more than 50% of the time speech communication proceeds in intervals between spoken words, methods to reduce the bandwidth requirements of the non speech intervals without interfering with the communication environment are desired.

DETAILED DESCRIPTION

Figure 1:
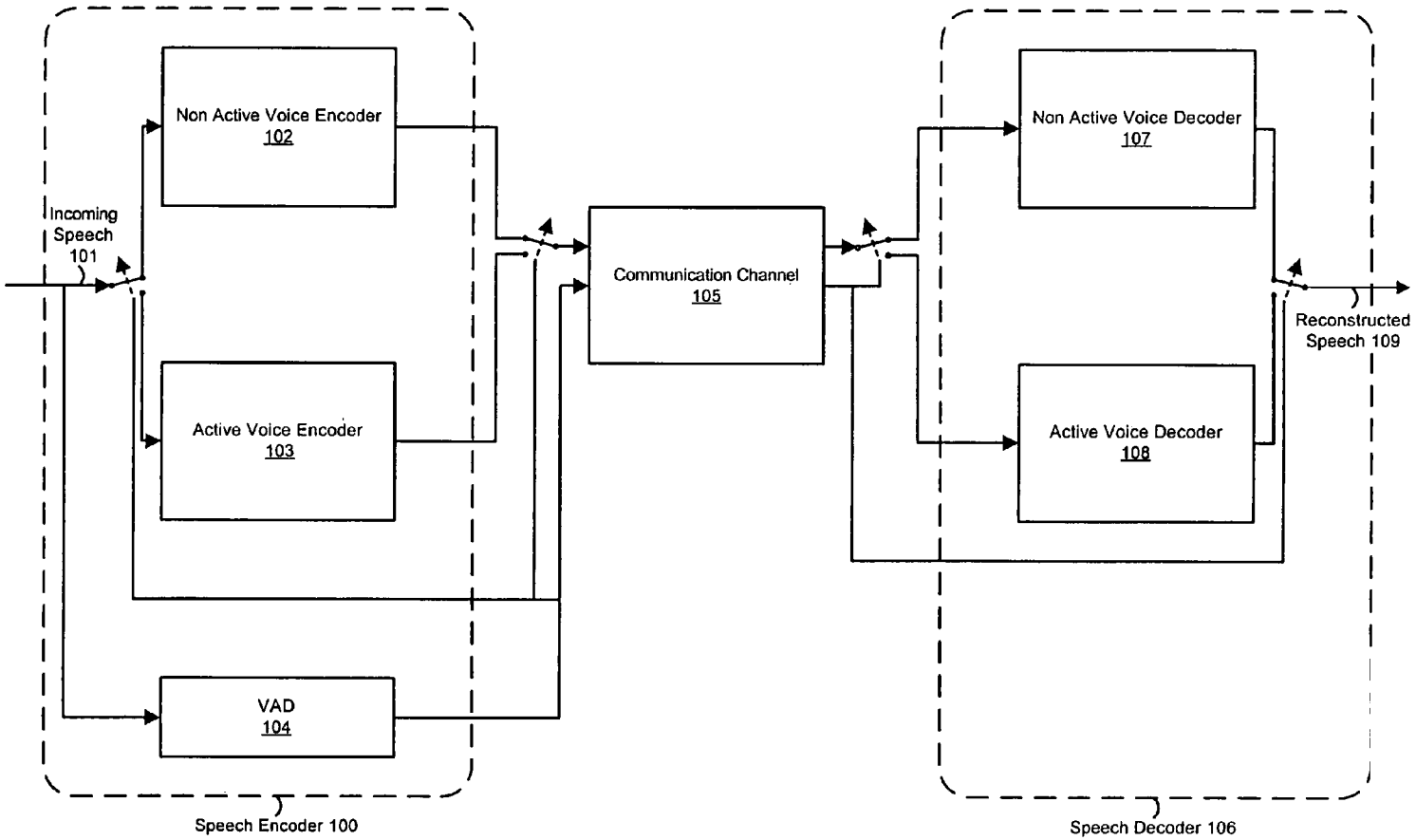
FIG. 1 (Prior Art)
FIG. 1 is a prior art block diagram of an encoder and decoder according to ITU-T G.729 Annex B.

Embodiments of a method for generating comfort noise for speech communication are described. Reference will now be made in detail to a description of these embodiments as illustrated in the drawings. While the embodiments will be described in connection with these drawings, there is no intent to limit them to drawings disclosed therein. On the contrary, the intent is to cover all alternatives, modifications, and equivalents within the spirit and scope of the described embodiments as defined by the accompanying claims.

Simply stated, an embodiment of the invention improves upon the G.729 Annex B comfort noise generation algorithm by reducing the computational complexity of the comfort noise generation algorithm. The computational complexity is reduced by reusing pre-computed random Gaussian noise samples for each non active voice frame versus calculating new random Gaussian noise samples for each non active voice frame as described by Annex B.

As introduced, Internet and multimedia speech communication applications benefit from maximized bandwidth utilization while simultaneously preserving an acceptable communication environment. The International Telecommunication Union in ITU-T Recommendation G.729 describes Coding of Speech at 8 kbit/s using Conjugate-Structure Algebraic-Code-Excited Linear-Prediction (CS-ACELP). Annex B adds a Silence Compression Scheme for G.729 Optimized for Terminals Conforming to Recommendation V.70. Each will be discussed in turn as an embodiment of the invention improves thereon.

The G.729 coder operates on 10 millisecond speech frames corresponding to 80 samples at 8000 samples per second. Each transmitted frame is first analyzed to extract CELP model parameters. The parameters include the following: line spectrum pairs ("LSP"); adaptive-codebook delay; pitch-delay parity; fixed codebook index; fixed codebook sign; codebook gains (stage 1); and codebook gains (stage 2). The parameters are encoded along with the voice signal and transmitted over a communication channel.

At the decoder side, the parameter indices are extracted and decoded to retrieve the coder parameters for the given 10 millisecond voice data frame. For each 5 millisecond subframe, the LSP [define acronym] coefficients determine linear prediction filter coefficients. A sum of adaptive codebook and fixed codebook vectors scaled by their respective gains determines an excitation. The speech signal is then reconstructed by filtering the excitation through the LP synthesis filter. The reconstructed voice signal then undergoes a variety of post-processing steps to enhance quality.

Incorporating Annex B into the encoding and decoding process adds additional algorithmic steps. The additional algorithms include voice activity detection, discontinuous transmission, and comfort noise generation. Each will be discussed in turn.

The purpose of the VAD is to determine whether or not there is voice activity present in the incoming signal. If the VAD detects voice activity, the signal is encoded, transmitted, and decoded per the G.729 Recommendation. If the VAD does not detect voice activity, it invokes the DTX and CNG algorithms to reduce the bandwidth requirement of the non voice signal while maintaining an acceptable listening environment.

Specifically, the VAD acts on the 10 millisecond frames and extracts four parameters from the incoming signal: the full and low band frame energies, the set of line spectral frequencies ("LSF") and the frame zero crossing rate. As the VAD does not instantly determine whether or not there is voice activity (e.g, it would be undesirable to have detection be so sensitive so as to rapidly switch between voice and non voice modes) it utilizes an initialization procedure to establish long-term averages of the extracted parameters. The VAD algorithm then calculates a set of difference parameters, the difference being between the current frame parameters and the running averages of the parameters. The difference parameters are the spectral distortion, the energy difference, the low band energy difference, and the zero-crossing difference.

The VAD then makes an initial decision as to whether or not it detects voice activity based on the four difference parameters. If the VAD decision is that it detects an active voice signal, the running averages are not updated. If the VAD decision is that it does not detect an active voice signal (e.g., a non active voice signal representing background noise) then the running averages are updated provided parameters of the background noise meet certain threshold criteria. The initial VAD decision is further smoothed to reflect the long-term stationary nature of the voice signal.

The VAD updates the running averages of the parameters and difference parameters upon meeting a condition. The VAD uses a first-order auto-regressive scheme to update the running average of the parameters. The coefficients for the auto-regressive scheme are different for each parameter, as are the coefficients used during the beginning of the active voice signal or when the VAD detects a large noise or voice signal characteristic change.

The intended result is that the VAD makes accurate and stable decisions about whether the incoming signal represents active voice or whether it is silence or background noise that can be represented with a lower average bit rate. Once the VAD has decided that a data frame is a non active voice frame, the DTX and CNG algorithms complete the silence compression scheme by adding discontinuous transfer and comfort noise generation.

The DTX operates on non active voice frames (as determined by the VAD algorithm) to determine whether or not updated parameters should be sent to the non active voice decoder. The DTX decision to update the non active voice decoder depends on absolute and adaptive thresholds on the frame energy and spectral distortion measure. If the decision is to update the parameters, the non active voice encoder encodes the appropriate parameters and sends the updated parameters to the non active voice decoder. The non active voice decoder can then generate a non active voice signal based on the updated parameters. If the frame does not trigger the absolute or adaptive thresholds, the non active voice decoder continues to generate a non active voice signal based on the most recently received update. The result is that the non active voice decoder generates a non active voice signal that mimics the signal that the VAD determines is not an active voice signal. Additionally, the non active voice signal can be updated if the background noise represented by the non active voice signal changes significantly, but does not consume bandwidth by constantly updating the non active voice decoder should the background noise remain stable.

The non active voice decoder generates comfort noise when the VAD does not detect voice activity. The CNG generates comfort noise by introducing a controlled pseudo-random (i.e., computer generated random) excitation signal into the LPC [define acronym] filters. The non active voice decoder then produces a non active voice signal much as it would an active voice signal. The pseudo-random excitation is a mixture of the active voice excitation and random Gaussian excitation. According to Annex B, the random Gaussian noise is computed for each of 40 samples in the two subframes of each non active voice frame. For each subframe, the comfort noise generation excitation begins by selecting a pitch lag within a fixed domain. Next, fixed codebook parameters are generated by random selections within the codebook grid. Then an adaptive excitation signal is calculated. The fixed codebook parameters and random excitation are combined to form a composite excitation signal. The composite excitation signal is then used to produce a comfort noise designed to mimic the background noise during the communication without consuming the transmission bandwidth required by an active voice signal.

During active voice signal transmission (i.e., an active voice frame), the active voice encoder and active voice decoder utilize 15 parameters to encode and decode the active voice signal. During a non active voice or silent frame, only 4 parameters are used to communicate the background noise or ambient conditions.

As noted, the CNG algorithm provided by Annex B causes the non active voice encoder and non active voice decoder to generate random Gaussian noise for every non active voice frame. The random noise generated every non active voice frame is interpolated with an excitation from the previous frame (active voice or non active voice) to smoothen abrupt changes in the voice signal. As 50% or more of an Internet or multimedia communication is non active, or silent, the random noise generation unnecessarily consumes processor bandwidth. For example, generating random noise per the Annex B algorithm requires approximately 11,000 processor cycles per non active voice frame.

An embodiment of the invention improves upon the step of generating new Gaussian random noise for each non active voice frame at the encoder. Given the nature of random Gaussian numbers, the random noise generated for any given frame has the same statistical properties as the random noise generated for any other non active frame. As the real background or ambient conditions change, scale factors can be used to match the composite excitation signal (the random noise being a component) to the real environment. In short, the encoder need not generate a new random noise signal for each non active voice frame because altering the scale factors only is sufficient to approximately match the scaled random noise and resulting composite excitation signal to ambient noise conditions. An embodiment of the invention pre-computes random Gaussian noise to create a noise sample template and re-uses the pre-computed noise to excite the synthesis filter for each subsequent non active voice frame. In an embodiment, there are 80 samples of random Gaussian noise, and the samples are stored in an 80 entry lookup table. The exact values of the random noise is not important, nor need it be reproduced in the decoder, provided that the statistical and spectral nature of the noise is retained in the transmitted signal. Re-using pre-computed random noise requires approximately 320 processor cycles per non active voice frame versus approximately 11,000 processor cycles to implement the Annex B CNG algorithm. There is little or no appreciable degradation in the quality of the comfort noise associated with a processor cycle savings of approximately 40 times.

The delay associated with sending and receiving a, for example, non active voice frame depends on the propagation delay and the algorithm delay. The propagation delay is independent of the selection of a comfort noise generation algorithm while the algorithm delay by definition is dependent on the algorithm. As noted above, the Annex B CNG algorithm requires approximately 11,000 processor cycles per non active voice frame while the CNG algorithm of an embodiment of the invention requires approximately 320 processor cycles. The reduction of processor cycles reduces the algorithm delay, in turn reducing the overall delay associated with sending and receiving a non active voice frame. The reduction of the overall delay improves the listening environment as a user would likely be familiar and comfortable with only propagation delay (e.g., the delay of a traditional telephone system).

Figure 2:
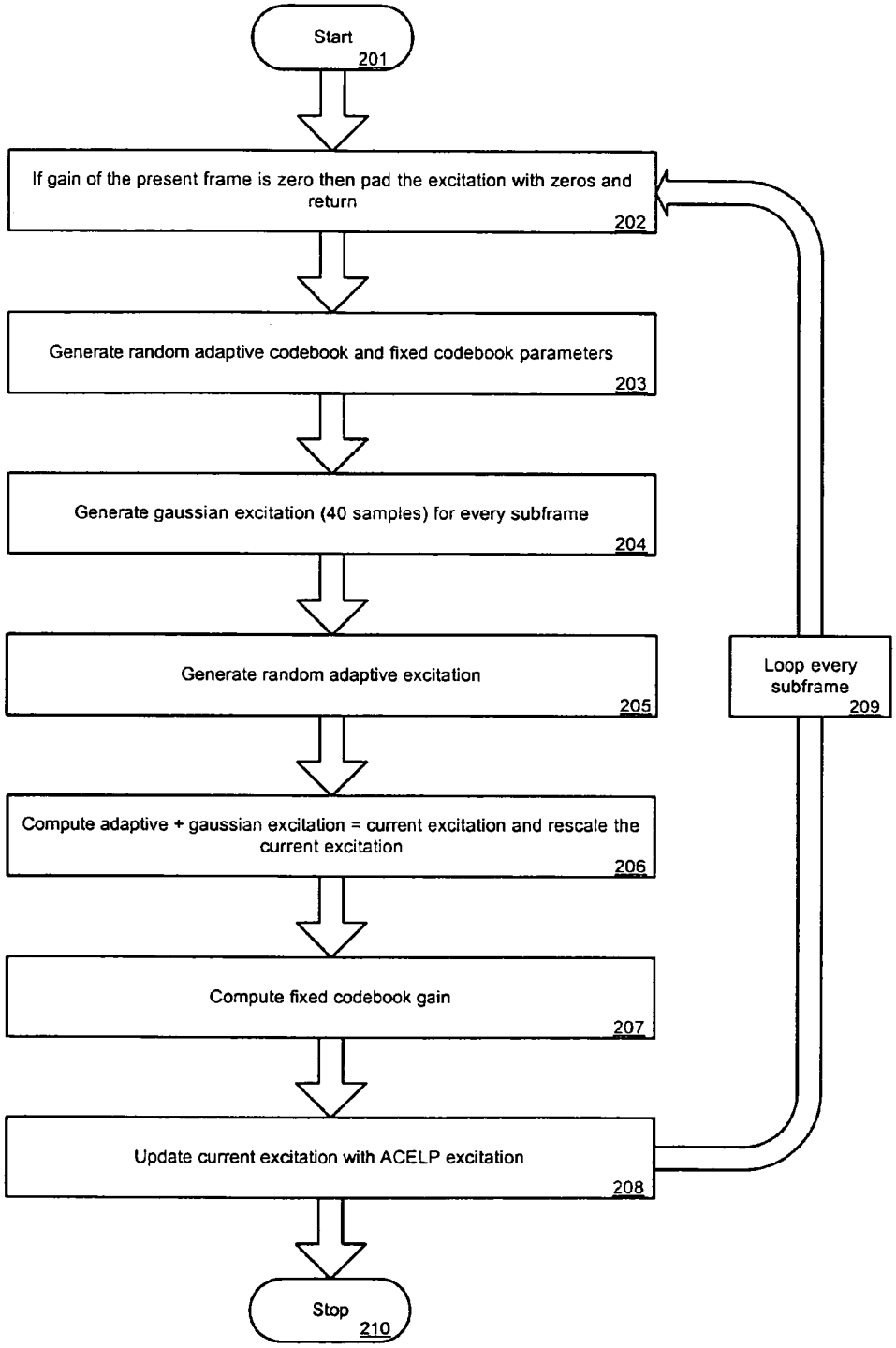
FIG. 2 (Prior Art)
FIG. 2 is a prior art comfort noise generation flow chart according to ITU-T G.729 Annex B.

Specifically in the prior art, and as illustrated by FIG. 2, a portion of the Annex B CNG algorithm begins with start 201. If the gain of the present frame is zero, then the algorithm pads the excitation with zeros, 202. The algorithm then generates random adaptive codebook and fixed codebook parameters, 203. 40 new samples of Gaussian excitation are then generated for each subframe, 204. Random adaptive excitation is generated, 205. The current excitation is computed by adding the adaptive and Gaussian excitation, and the current excitation is rescaled, 206. The algorithm then computes the fixed codebook gain, 207, and updates the current excitation with the ACELP excitation, 208. The process loops for every subframe, 209, that is a non active voice subframe until the subframe is an active voice frame at which point the loop stops, 210.

Figure 3:
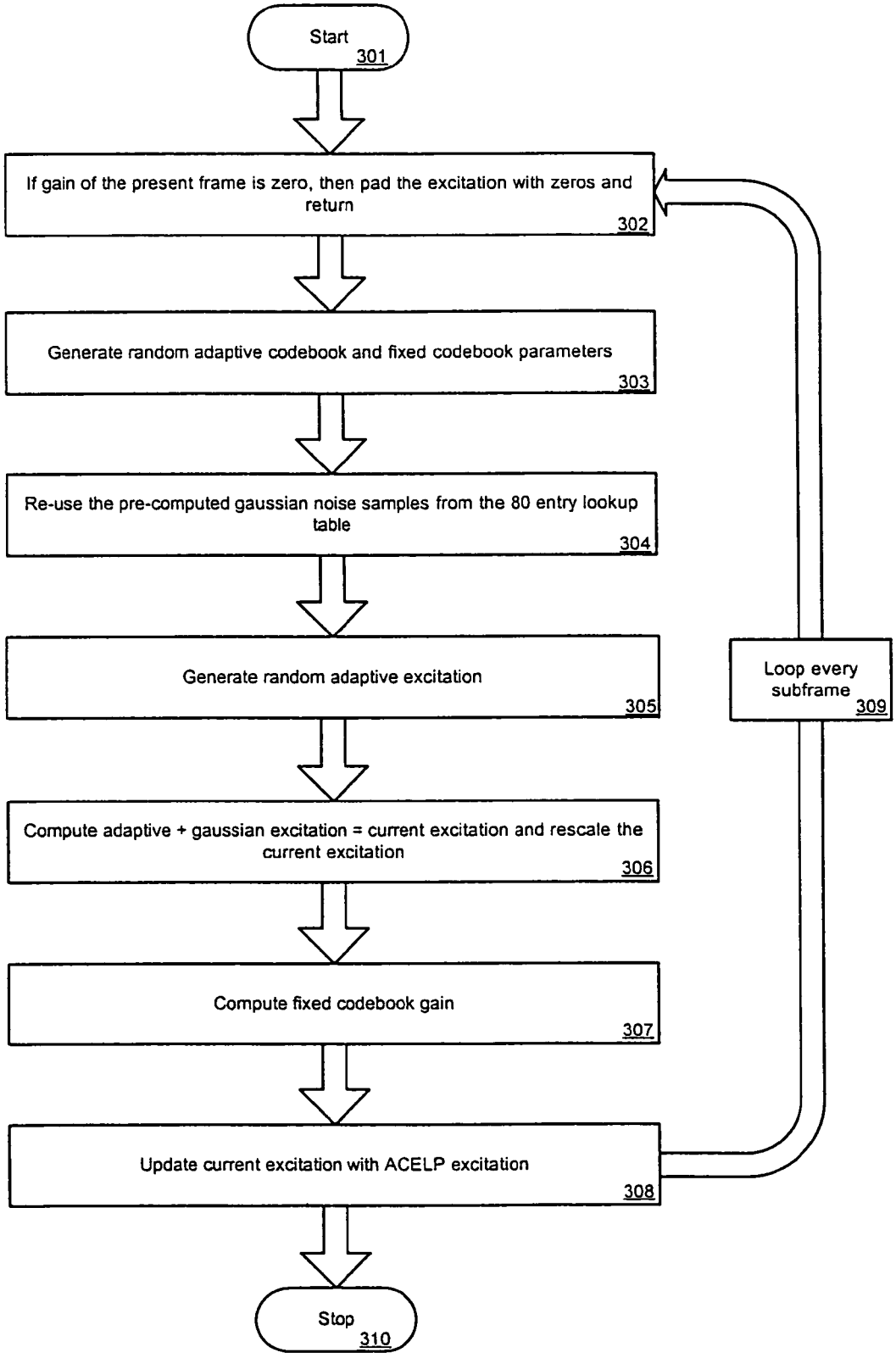
FIG. 3 is a comfort noise generation flow chart according to an embodiment of the invention.

FIG. 3 illustrates a flow chart depicting an embodiment of the invention. A portion of the algorithm of an embodiment begins with start 301. If the gain of the present frame is zero, then the algorithm pads the excitation with zeros, 302. The algorithm then generates random adaptive codebook and fixed codebook parameters, 303. The algorithm re-uses pre-computed Gaussian noise samples to generate Gaussian excitation from an 80 entry lookup table (i.e., 80 Gaussian noise samples), 304. Random adaptive excitation is generated, 305. The current excitation is computed by adding the adaptive and Gaussian excitation, and the current excitation is rescaled, 306. The algorithm then computes the fixed codebook gain, 307, and updates the current excitation with the ACELP excitation, 308. The process loops for every subframe, 309, that is a non active voice subframe until the subframe is an active voice frame at which point the loop stops, 310.

The novel improvement lies in the difference between the encoder generating Gaussian noise for every subframe, 204, and re-using pre-computed Gaussian noise from the, for example, 80 entry lookup table, 304. The benefit of an embodiment of the invention is that it reduces the computational complexity, and corresponding algorithm delay, of comfort noise generation. In particular, new random numbers need not be generated for every non active voice frame at the encoder; rather, a single set of random numbers covering the duration of one frame can be computed and re-used in all other non active voice frames that trigger comfort noise generation without causing any perceivable degradation and distortion to the listener. An embodiment of the invention reduces the need for continuous real-time computation of Adaptive White Gaussian Noise ("AWGN") by utilizing an array or template of pre-computed random numbers. The array of pre-computed random numbers are re-used for all comfort noise frames to adapt the synthesis filter. The result is that an embodiment of the invention simplifies the most computationally demanding element of comfort noise generation for every comfort noise frame in the encoder.

The goal of the Annex B VAD, DTX, and CNG elements is better served by an embodiment of the invention in that the embodiment generates an equally acceptable, for example, Internet and multimedia communication environment while consuming fewer computing resources. As noted, there is no appreciable degradation in the quality of the generated comfort noise, and the processor bandwidth savings are significant.

It is important to note that the algorithm is not limited to Internet and multimedia communication, but can be incorporated into any telecommunication application that would benefit from the reduced computational requirements of the CNG algorithm of an embodiment of the invention. It is appreciated that such a telecommunication application may be implemented by a storage medium containing content which, when executed by an accessing machine, causes the accessing machine to perform an algorithm according to any of a variety of techniques described herein. Further, while the CNG algorithm has been described with reference to the encoder side of the Annex B standard, the use of the CNG algorithm of an embodiment of the invention is not limited to Annex B. Rather, the CNG algorithm, in particular the re-use of pre-computed random numbers, can be applied to any comfort noise generation scheme.

One skilled in the art will recognize the elegance of the disclosed embodiment in that it decreases the computational complexity of creating comfort noise that accurately mimics background noise during periods of silence. It is an improved solution to creating a comfortable communication environment while reducing the processor load to do so.

What is claimed is:

1. A method comprising:

computing a plurality of random noise samples;

storing the plurality of random noise samples in a lookup table;

detecting for a voice activity in a signal; and if the voice activity is not detected, encoding a first data frame of the signal to create a first non active voice frame, including generating a first excitation based on the plurality of random noise samples of the lookup table; and generating the first non active voice frame based on a scale factor and the first excitation; and after encoding the first data frame of the signal, reusing the already generated first excitation to encode each subsequent data frame of the signal until a voice activity of the signal is detected, each encoding of a respective subsequent data frame of the signal including altering the scale factor based on any change in a noise condition of the signal, and generating a respective non active voice frame based on the scale factor and the already generated first excitation of the first data frame.

2. The method of claim 1 further comprising padding an excitation with zeros if a gain of a frame of the non active voice signal is zero.

3. The method of claim 2 further comprising generating random adaptive codebook parameters and fixed codebook parameters.

4. The method of claim 3 wherein generating the first excitation includes:

generating a random adaptive excitation based on the random adaptive codebook parameters;

computing a sum of the random adaptive excitation and one of the random noise samples; and rescaling the sum of the random adaptive excitation and one of the random noise samples.

5. The method of claim 4 wherein generating the first excitation further includes:

computing a fixed codebook gain based on the fixed codebook parameters; and updating the rescaled excitation with an algebraic-code-excited linear-prediction excitation.

6. The method of claim 1 wherein the random noise samples are Gaussian noise samples.

7. A storage medium comprising content, which when executed by an accessing machine, causes the accessing machine to implement a method comprising:

computing a plurality of random noise samples;

storing the plurality of random noise samples in a lookup table;

detecting for a voice activity in a signal; and if the voice activity is not detected, encoding a first data frame of the signal to create a first non active voice frame, including generating a first excitation based on the plurality of random noise samples of the lookup table, and generating the first non active voice frame based on a scale factor and the first excitation; and after encoding the first data frame of the signal, reusing already generated first excitation to encode each subsequent data frame of the signal until a voice activity of the signal is detected, each encoding of a respective subsequent data frame of the signal including altering the scale factor based on any change in a noise condition of the signal, and generating a respective non active voice frame based on the scale factor and the already generated first excitation of the first data frame.

8. The storage medium of claim 7 the method further comprising padding an excitation with zeros if a gain of a frame of the non active voice signal is zero.

9. The storage medium of claim 8 the method further comprising generating random adaptive codebook parameters and fixed codebook parameters.

10. The storage medium of claim 9 wherein generating the first excitation includes:

generating a random adaptive excitation based on the random adaptive codebook parameters;

computing a sum of the random adaptive excitation and one of the random noise samples; and rescaling the sum of the random adaptive excitation and one of the random noise samples.

11. The storage medium of claim 10 wherein generating the first excitation further includes:

computing a fixed codebook gain based on the fixed codebook parameters; and updating the rescaled excitation with an algebraic-code-excited linear-prediction excitation.

12. The storage medium of claim 7 wherein the random noise samples are Gaussian noise samples.

13. An apparatus comprising:

an encoder coupled to a communication channel wherein the encoder is to compute a plurality of random noise samples and to store the plurality of random noise samples in a lookup table, the encoder further to encode, if a voice activity is not detected in a signal, a first data frame of the signal to create a first non active voice frame, wherein the encoder is to generate a first excitation based on the plurality of random noise samples of the lookup table, and to generate the first non active voice frame based on a scale factor and the first excitation, the encoder further to reuse the already generated first excitation after encoding the first data frame of the signal to encode each subsequent data frame of the signal until a voice activity of the signal is detected, wherein for each encoding of a respective subsequent data frame of the signal the encoder is to alter the scale factor based on any change in a noise condition of the signal, and to generate a respective non active voice frame based on the scale factor and the already generated first excitation of the first data frame; and a voice activity detector coupled to the encoder to detect for a non active voice signal.

14. The apparatus of claim 13, the encoder further configured to pad an excitation with zeros if a gain of the signal is zero.

15. The apparatus of claim 14, the encoder further configured to generate random adaptive codebook parameters and fixed codebook parameters.

16. The apparatus of claim 15, wherein generating the first excitation includes:

generating a random adaptive excitation based on the random adaptive codebook parameters;

computing a sum of the random adaptive excitation and one of the random noise samples; and rescaling the sum of the random adaptive excitation and one of the random noise samples.

17. The apparatus of claim 16, wherein generating the first excitation further includes:

computing a fixed codebook gain based on the fixed codebook parameters; and updating the rescaled excitation with an algebraic-code-excited linear-prediction excitation.

18. The apparatus of claim 13 wherein the random noise samples are Gaussian noise samples.

19. A storage medium containing content which, when executed by an accessing machine, causes the accessing machine to generate:

an encoder coupled to a communication channel wherein the encoder is to compute a plurality of random noise samples and to store the plurality of random noise samples in a lookup table, the encoder further to encode, if a voice activity is not detected in a signal, a first data frame of the signal to create a first non active voice frame, wherein the encoder is to generate a first excitation based on the plurality of random noise samples of the lookup table, and to generate the first non active voice frame based on a scale factor and the first excitation, the encoder further to reuse the already generated first excitation after encoding the first data frame of the signal to encode each subsequent data frame of the signal until a voice activity of the signal is detected, wherein for each encoding of a respective subsequent data frame of the signal the encoder is to alter the scale factor based on any change in a noise condition of the signal, and to generate a respective non active voice frame based on the scale factor and the already generated first excitation of the first data frame; and a voice activity detector coupled to the encoder to detect for the non active voice signal.

20. The storage medium of claim 19, the encoder further configured to pad an excitation with zeros if a gain of a frame of the non active voice signal is zero.

21. The storage medium of claim 20, the encoder further configured to generate random adaptive codebook parameters and fixed codebook parameters.

22. The storage medium of claim 21, wherein generating the first excitation includes:

generating a random adaptive excitation based on the random adaptive codebook parameters;

computing a sum of the random adaptive excitation and one of the random noise samples; and rescaling the sum of the random adaptive excitation and one of the random noise samples.

23. The storage medium of claim 22, wherein generating the first excitation further includes:

computing a fixed codebook gain based on the fixed codebook parameters; and updating the rescaled excitation with an algebraic-code-excited linear-prediction excitation.

24. The storage medium of claim 19 wherein the random noise samples are Gaussian noise samples.

* * * * *